United States Patent [19]

Bean et al.

[11] 4,124,287

[45] Nov. 7, 1978

[54] IMAGING SYSTEM UTILIZING UNCHARGED MARKING PARTICLES

[75] Inventors: Lloyd F. Bean, Rochester; Roger L. Miller, Penfield, both of N.Y.

[73] Assignee: Xerox Corporation, Stamford, Conn.

[21] Appl. No.: 783,095

[22] Filed: Mar. 31, 1977

[51] Int. Cl.[2] ..... G03G 15/00

[52] U.S. Cl. ..... 355/3 R; 118/657; 118/DIG. 5; 346/153; 355/3 DD; 355/3 CH; 355/10

[58] Field of Search ..... 355/3 R, 3 DD, 3 CH, 355/10; 96/1 R, 1 SD, 1 C, 1.3; 346/153; 118/653–658, DIG. 23, DIG. 5

[56] References Cited

U.S. PATENT DOCUMENTS

| | | | |
|---|---|---|---|
| 3,234,017 | 2/1966 | Heyl et al. | 96/1 |
| 3,450,831 | 6/1969 | Gaynor | 96/1.3 X |
| 3,532,494 | 10/1970 | Bhagat | 355/3 CH |
| 3,543,022 | 11/1970 | Lennon | 96/1 C |
| 4,048,921 | 9/1977 | Raschke | 346/153 X |

*Primary Examiner*—R. L. Moses

[57] ABSTRACT

An apparatus for imagewise marking a photoconductive imaging surface includes a means for forming an imagewise non-uniform charge pattern on the surface and a means for contacting the surface with uncharged marking particles.

16 Claims, 17 Drawing Figures

IMAGING SYSTEM UTILIZING UNCHARGED MARKING PARTICLES

BACKGROUND OF THE INVENTION

The present invention relates generally to the formation and development of charge patterns and more particularly to the formation of imagewise non-uniform charge patterns and the development thereof with finely divided marking material.

In conventional xerography, a photoconductive surface is uniformly charged in the dark with a charge of one polarity. The charged surface is exposed to a pattern of radiation to which it is sensitive, and the charge is dissipated in the radiation-struck areas. An imagewise uniform charge pattern remains in the non-radiation-struck areas.

The imagewise uniform charge pattern is normally developed by contacting the surface with a finely divided, colored toner which carries a charge of the opposite polarity. Because opposite polarities attract, the toner particles adhere to the photoconductive surface in the area of the uniform charge pattern.

The toner particles are most usually charged to the opposite polarity prior to development by rubbing contact with a carrier material. The carrier material is one which is removed from the toner material in the triboelectric series. The carrier material is usually in the form of particles of a larger size than the toner particles; although the carrier may, in some cases, be a liquid.

The toner is usually applied to the surface by cascading or flowing the toner or a toner-carrier combination (generally referred to as developer) across the surface. Other well known toner application methods include magnetic brush development, electrophoretic development and out-of-contact liquid development, such as that described in U.S. Pat. No. 3,084,043 to Gundlach.

Normal xerographic development has met with great commercial success. However, there remain areas where improvement is desirable. For example, photoconductive surfaces useful in most commercial xerographic development should be from about 10 to about 60 microns thick. Such thicknesses can be expensive and complicated to manufacture. Any imaging process which enables the use of thinner photoconductive layers would be an improvement.

The toner-carrier combination which is well known in normal xerography is somewhat dependent on the ambient relative humidity for successful operation. The humidity is preferably lower. Proper triboelectric charging of the toner is difficult if the humidity is too high.

Another difficulty of the toner-carrier combination is that the carrier can become coated with a thin layer of toner material after long periods of use. This is generally referred to as carrier aging. Such coated carrier material cannot be used efficiently to triboelectrically charge the toner material.

An imaging process which enables the use of a toner material which does not have to be charged to one polarity or another before development is also desirable. A toner material which is readily useful without a carrier material would also be an improvement.

In normal xerography, the toner particles adhere to (develop) the photoconductive surface at the point of charge differential. For example, in normal xerography a plate is charged to about 1,000 v. and then imagewise exposed. Exposure reduces the charge in the light struck areas to about 200 v., leaving about 800 v. in non-light struck areas. The line between a 200 v. area and an 800 v. area on a surface attracts toner particles (see FIG. 1). However, solid area coverage of a large area of uniform 800 v. charge cannot normally be accomplished without the aid of such sophisticated and complex mechanisms as magnetic brush developers or development electrode systems. U.S. Pat. No. 2,777,418 to Gundlach shows a typical development electrode used to achieve said area coverage of a large uniform charge pattern using charged toner. A development system which would make available solid area coverage without such complex mechanisms and with uncharged toner is desirable.

Even when magnetic brush development and a developer electrode are used to achieve solid area development, the problem of "developer starvation" is observed. This undesirable phenomenon manifests itself as a reduction of density as large solid areas are developed. The reduction can be quite dramatic and unattractive.

It is generally understood to occur because of the limited speed at which the typical toner-carrier type of developer can provide sufficient toner particles of the proper polarity. The development of a charge pattern by a toner particle of one charge leaves a net opposite charge on the carrier. This results in the carrier attracting the remaining toner with an increased attraction, making it more difficult for the remaining toner to leave the carrier and develop subsequent charge patterns. Normally this undesirable situation can be remedied only by replenishing the carrier with toner. A marking method which avoids developer starvation would be useful.

In normal xerography, a developed image must oftentimes be transferred to a receiving sheet if it is to be useful. Such transfer is a critical operation which must be handled carefully and with great control to achieve complete transfer while avoiding smearing.

There are normal xerographic methods which avoid transfer by coating a photoconductive layer on a conductive paper and developing the image directly on the coated paper. However, these methods require conductive papers and expensive coating treatments during manufacture. They also often lend themselves to liquid (bath) development which can be relatively slow and which sometimes can produce damp copies having an unpleasant odor.

An imaging system which can avoid the difficulties associated with the normal xerographic transfer step is desirable. An imaging system which enables development directly onto the final copy while avoiding the need for a photoconductive coating on the final copy and the need for liquid development also would be useful.

Other image development systems have been achieved which do not overcome these disadvantages. For example, in U.S. Pat. No. 3,318,698, F. A. Schwertz discloses a means for creating a charge pattern on an insulating surface. The surface is first frosted in an imagewise pattern and then uniformly charged. The frosted areas retain less of a charge than do the unfrosted areas, and a charge differential is created between the charged and uncharged areas. The charge differential of Schwertz is developable by well known xerographic methods. However, because the charge pattern of Schwertz is all of one polarity, it requires a toner which is triboelectrically charged to the opposite polarity. The system disclosed by Schwertz also has the solid area coverage problems discussed above in connection with charge differential development.

In U.S. Pat. No. 3,043,217 to L. E. Walkup, there is disclosed a development system in which a charge pattern is formed on an insulating surface and is developed with a typical xerographic developer. Although this system has many uses, it also shares many of the disadvantages of the Schwertz method.

In U.S. Pat. No. 3,250,636 to R. A. Wilferth, a magnetic imaging system is disclosed. In that system, a non-uniform pattern of magnetic microfields is established in a magnetizable layer. The uniform pattern is selectively removed by Curie point erasure, leaving an imagewise pattern of magnetic microfields. Curie point erasure is a well known technique and comprises heating a magnetized material above a known critical temperature at which its molecules become disoriented and the material loses its magnetic properties. Curie point erasure is sometimes accomplished by such techniques as flash heating a magnetized material with a Xenon flash lamp while protecting the image area with a mask.

While the technique of Wilferth avoids the solid area coverage problems of the prior art, it requires a magnetizable imaging layer and magnetically attractable toner particles and it is not compatible with well known optical imaging methods. Also, it is generally limited to forming dark images because magnetically attractable toners are most usually of a rust or black color.

Maksymiak, in U.S. Pat. No. 3,759,222 discloses the use of a non-uniform charge pattern on a transfer member to transport magnetic toner particles to an imaging member which carries a magnetic image. The transfer member of Maksymiak comprises a conductive drum coated with a thin dielectric layer on which is supported a conductive screen. A potential difference is established between the screen and the drum so that a non-uniform charge pattern exists over the surface of the drum. The transport member of Maksymiak does not provide an imagewise non-uniform charge pattern and does not overcome the difficulties of magnetic imaging pointed out above.

The existence of field gradients at the edges of xerographic charge patterns and in periodic xerographic charge patterns has been disclosed by H. E. J. Neugebauer (Appl. Opt. 3, 385 (1964) and R. M. Schaffert, Phot. Sci. Eng. 6, 197 (1962). However, the use of conductive toners to attempt to develop such field gradients results in discharge and loss of the image. The use of charged insulating toners or uncharged insulating toners results only in edge development, as described above and in connection with FIG. 1, below.

SUMMARY OF THE INVENTION

It is, therefore, an object of the present invention to overcome the disadvantages of the prior art.

It is also an object of the present invention to furnish an apparatus for imagewise marking a photoconductive imaging surface.

It is another object of the present invention to furnish an apparatus for marking a photoconductive imaging surface having a thin photoconductive layer.

It is still another object of the present invention to disclose an apparatus for creating an image having a good solid area coverage.

It is a further object of the present invention to supply an apparatus for marking an imaging surface which avoids the phenomenon of "developer starvation".

It is still another object of the present invention to furnish an apparatus for development of a non-uniform charge pattern with an uncharged marking particle.

These and other objects are accomplished by an apparatus which comprises, generally speaking, a means for forming an imagewise non-uniform charge pattern on a photoconductive surface and a means for contacting the pattern with a finely divided uncharged marking material.

The means for forming an imagewise non-uniform charge pattern includes, in a preferred embodiment, means for uniformly charging a photoconductive surface, means for exposing the surface to a regular pattern of dark and light and means for subsequently exposing the surface to an imagewise pattern of light. Other useful means for forming an imagewise non-uniform charge pattern are described below.

The means for contacting the imagewise non-uniform charge pattern with finely divided uncharged marking particles can be selected from a variety of useful means such as fluidized beds, magnetic and electric brushes and arrangements for flowing marking particles over the photoconductive surface.

BRIEF DESCRIPTION OF THE DRAWINGS

The invention will now be described with reference to the drawings in which.

DETAILED DESCRIPTION

Figure 1:
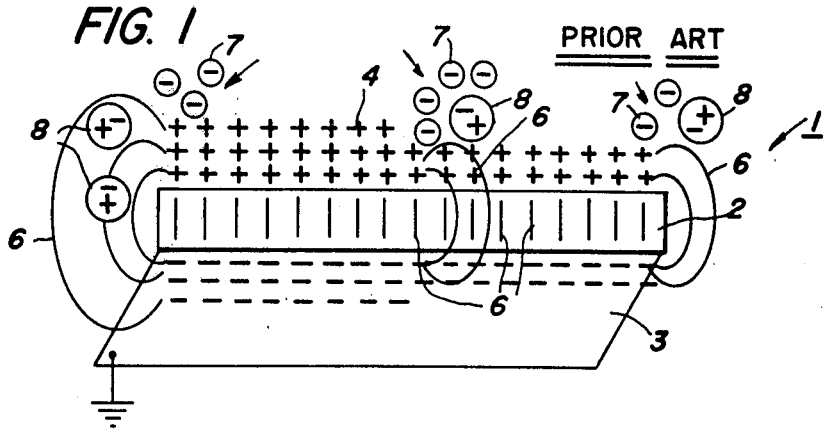
FIG. 1 shows a charge pattern of the prior art and its effect on charged and uncharged marking particles.

Referring more specifically to FIG. 1, there is shown schematically and in cross-section an imaging member supporting a charge pattern typical of the prior art.

Imaging member 1 comprises photoconductive layer 2 on grounded conductive substrate 3. The charge pattern is typical of those used in xerography. It includes areas 4 of relatively high charge and areas 5 of relatively low charge.

Lines 6 depict the shape of the electric field between the positive charges in areas 4 and 5 of the charge pattern and the corresponding negative charges at the interface between layer 2 in the central part of areas 4 and 5. However, at the edges of areas 4 and 5 and at the location where areas 4 and 5 meet, the shape of the field is defined by loops. The lines 6 defining the loops indicate by their varied closeness a high concentration of charge (or a convergence of the field) in areas where the lines are closest.

Paricles 7 show the behavior of charged toner particles in the presence of such a field. It is well known in the prior art that such particles tend to preferentially develop charge differentials such as the location where areas 4 and 5 meet. That is, particles 7 tend to preferentially develop the areas of greater field strength.

Particles 7 are negatively charged and is attracted to the positively charged image, as shown by the arrows. The force of the attraction is according to the well known formula $F = qE$, where $F$ = force; $q$ = charge and $E$ = field. The phenomenon of preferential edge development is explained by this relation of force, charge and field strength. The charge particles 7 experience a stronger force of adhesion to surface 2 at locations where the concentration of lines of force on surface 2 is more dense.

The effect of the prior art charge patterns of FIG. 1 on an uncharged particle is shown by particles 8. A dipole is induced in particles 8 so as to reduce the field inside the particle. The extent of this polarization depends on the field strength and the dielectric constant, K, of the particles 8. In a uniform field the forces exerted by the field on the charges at each end of particles 8 are equal and opposite, so no net force results. However, in a convergent field, depicted by lines 6 where they form loops, a net force results in the direction of convergence. For small spherical particles 8 in air the net force is given by the equation:

$$\vec{F} = 2\pi\,\epsilon_o \alpha^3 \frac{K-1}{K+2} \vec{\nabla}(E^2)$$

where:

$\vec{F}$ = force in Newtons
$\epsilon_o$ = permittivity of space ($8.85 \times 10^{-12}$)
$\alpha$ = radius
$K$ = dielectric constant
$\vec{\nabla}$ = field gradient del vector
$E$ = electrostatic field.

In FIG. 1 uncharged particles 8 are preferentially drawn to the areas of charge differential (or field convergence). It is seen in FIG. 1 that neither charged nor uncharged particles 7 or 8 develop the areas of uniform charge between the locations of charge differential or field convergence.

Figure 2:
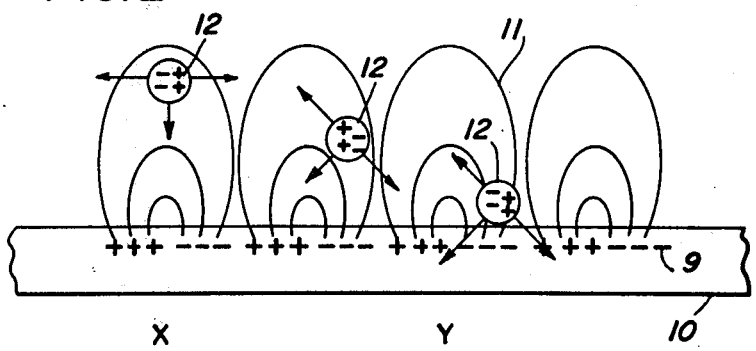
FIG. 2 shows a non-uniform charge pattern of the present invention and its effect on an uncharged marking particle.

Referring more specifically to FIG. 2, there is shown schematically and in cross-section a non-uniform charge pattern in accordance with the present invention. The non-uniform charge pattern is created by an alternating positive and negative charge pattern 9 on surface 10. Lines 11 indicate the direction of the electric field created by pattern 9.

The effect of such a field on uncharged dielectric particles 12 can be seen by observing the force vector arrows beside particles 12. The resultant force on particles 12 is down toward surface 9, even though particles 12 are uncharged. The mechanism of the attraction of particles 12 to the points of convergence of the lines of force on surface 9 is more fully explained in connection with the description of particle 8 in FIG. 1. However, in contrast with FIG. 1 where the downward force is observed only at the location of gross charge differential, the resultant downward force of FIG. 2 is observed at substantially all locations on surface 10 where pattern 9 exists. Such a phenomenon results in a substantially uniform coating of surface 10 in the areas of the non-uniform charge pattern whenever contacted with uncharged particles such as particles 12.

Suitable surfaces for use in the practice of the present invention include those which will support an alternating charge pattern or voltage pattern. Any such suitable surface may be used. Insulating coatings and photoconductive layers are typical of suitable surfaces. For example, the insulating coating may be a thin dielectric layer placed on ordinary paper or, more preferably, on conductive paper.

It is observed that the minimum useful voltage in charge pattern 9 which can attract particles 12 is about 100 v. Thus, the surface should be capable of supporting at least a 50 v. potential by virtue of its dielectric strength and thickness. A +50 v. potential which alternates with a −50 v. potential provides the total 100 v. potential difference normally required to attract uncharged toner particles. If, for example, the surface is a vinyl resin, a thickness of at least about 0.5 micron is necessary to support a potential of 50 v., although thicker coatings are more typically encountered. No maximum thickness of the insulating layer has been identified, and practical considerations can be allowed to limit the maximum thickness of the layer.

Typical well known photoconductive materials such as selenium, selenium alloys, zinc oxide and PVK/TNF, all of which are useful in the present invention, will generally support about 40 v. per micron in the dark. Because a potential of at least about 100 v. is required to attract particles 12, the minimum useful thickness is about 1.25 microns when the surface is one of these photoconductors and the non-uniform charge pattern is an alternating +50 v./−50 v. potential. As explained further in connection with FIG. 4B, thinner photoconductive layers enable greater resolution.

To be useful, particles 12 should have a dielectric constant higher than their surrounding medium. Dielectric constant is here viewed as a measure of the ability of a material to be internally polarized responsive to an electric field. The more readily polarizable, the higher the dielectric constant. For example, free space as well as air has a dielectric constant of about 1.0 and conductive metals, such as silver, have a dielectric constant of infinity.

In the present invention, particles 12 are found to be useful whenever their dielectric constant is at least about 1.5 greater than the surrounding medium. For example, when the surrounding medium is air, the dielectric constant of particles 12 is normally at least about 2.5. In rare cases a dielectric constant of less than 2.5 is encountered in useful particles, such as in toner particles made from air-containing materials. Typical of such materials are styrofoam microspheres similar to those used in the manufacture of light weight paper. Higher dielectric constants are often encountered.

It is important that the particles not discharge the image. In some cases, such as when layer 10 is a selenium photoconductor, particles 12 should be insulating at least for the time of the development step. However, in other cases, such as when layer 10 is an insulating layer, metal particles 12 can be used without fear of discharging the image.

Particle 12 can be of any size suitable for imagewise marking on the surface of layer 10. Although the particle may be any useful size, its upper size limit is usually determined the desire for high resolution images. Particles which are larger than about 30 microns sometimes produce images which have an undesirable grain or roughness and a lack of fine definition.

Generally speaking, the smaller the particles, the higher the achievable resolution. However, there is a lower practical limit for particle size which is caused by handling difficulties except in liquid suspension development systems. It is observed that particles having an average diameter of less than about 5 microns often become airborn to cause unwanted dust accumulation. Particles smaller than about 5 microns also give rise to transfer difficulties whenever the developed image is transferred to a receiver sheet and to cleaning difficulties in preparing the imaging surface for recycling.

Resolution of the developed image is also determined, to some extent, by the frequency of the non-uniformity in the charge pattern. The frequency of the non-uniformity can be defined as the reciprocal of the period. The period is the distance between $x$ and $y$ in FIG. 2. The frequency can be varied to give any suitable resolution in the developed image. Periods which provide typically useful frequencies are from about 25 microns to about 175 microns with toner particles which range from about 5 to about 30 microns.

Cosmetically undesirable roughness begins to appear when toner particles of 10 microns are used to develop non-uniform charge patterns having a period of 175 microns or greater. This relationship of 10 micron particles to a 175 micron period (0.06) can conveniently be used as a threshold ratio for cosmetically desirable development of charge patterns.

Particles 12 can be dyed and pigmented in a great variety of colors as long as the colorant does not adversely effect the dielectric constant of the particles. Any suitable dye or pigment can be used to color particles 12. The manufacture of colored materials, such as thermoplastics, having dielectric constants of around 3.0 is well known in the art. Particles of such material are readily available from commercial sources. Such variously colored materials are useful in the development of non-uniform imagewise charge patterns in a wide range of colors.

This ability to develop non-uniform charge patterns in a wide variety of colors is an important advantage of the present invention. The great variety of colors and hues which are possible is discussed by E. J. G. Balley in his paper "The Coloration of Plastics", Journal of the Society of Colorists and Dyers, p. 571–578, Dec. 1969.

Figure 3:
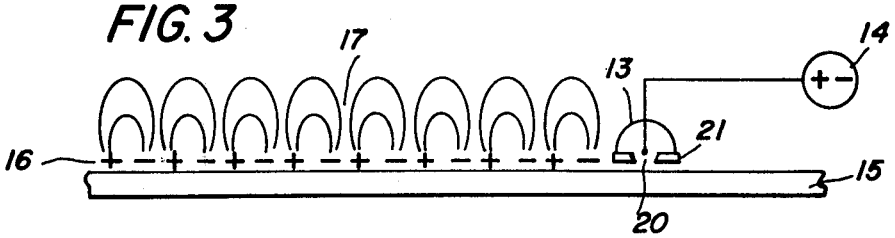
FIG. 3 shows a method for making an imagewise non-uniform charge pattern on an insulating surface.

Referring more specifically to FIG. 3, there is shown in cross-section a method for forming a non-uniform charge pattern on an insulating surface.

In FIG. 3, a corona charging device 13 is driven by an alternating positive and negative current supply 14 as it moves across the surface of layer 15 in the direction shown by the arrow. Device 13 leaves in its path a non-uniform pattern 16 of positive and negative charges. To increase definition, charging is preferably through slit 20 in shield 21. Lines 17 indicate the shape of the electric field resulting from the non-uniform pattern.

Surface 15 is any suitable insulating layer, as described in connection with FIG. 2. Corona charging devices, such as device 13, are well known in the art.

The alternating positive and negative charge applied to corona device 13 can be any useful charge, as described in connection with FIG. 2. The resulting surface potential typically varies between +50 v. and ±500 v. A more commonly encountered charge density on the insulating surface after charging as shown in FIG. 3 is ±300 v. A non-uniform charge pattern that varies between +50 v. and −50 v. provides a 100 v. net potential difference which is adequate to attract uncharged particles.

It will be clear to those skilled in the art that a stylus could be substituted for corona device 13. A stylus which makes point contact with the imaging surface would be preferred. It will also be apparent that the charge applied to a stylus or to corona device 13 could alternate between + or − and 0 instead of alternating between + and − as does current supply 14. Further, a stylus can be selectively activated to produce an imagewise non-uniform charge pattern responsive to such remote control as a computer or an optical scanner.

Referring more specifically to FIGS. 4A–F, there are shown in cross-section various methods for establishing an imagewise non-uniform charge pattern on a photoconductive surface.

Figure 4A:
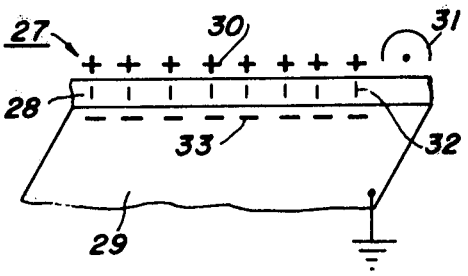
FIGS. 4A–F show methods for making an imagewise non-uniform charge pattern on a photoconductive surface.

In FIG. 4A, there is shown imaging member 27 which includes photoconductive layer 28 and conductive substrate 29. Any of the well known photoconductive layers typical of those common to xerography are useful. A variety of such layers will be apparent to those familiar with the art.

A uniform pattern of charge 30 is placed on layer 28 by corona device 31 as it moves across the surface of layer 28 in the direction shown by the arrow. Lines 32 show the direction of the field created by pattern 30 across layer 28. Conductive substrate 29 is grounded, and a layer of negative charge 33 arises at the interface between substrate 29 and layer 28 when layer 28 is charged in the dark, as is well known in xerography.

Figure 4B:
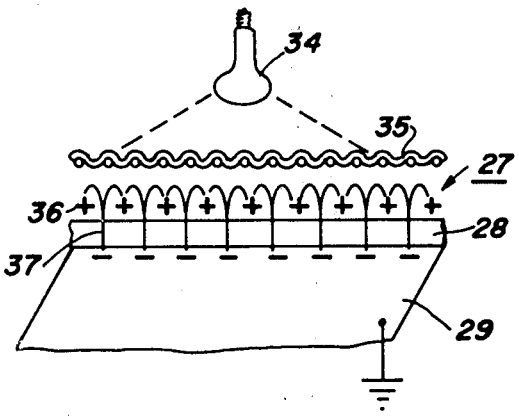

In FIG. 4B, charged layer 27 of FIG. 4A is exposed to radiation to which it is sensitive from light source 34. Exposure is through screen 35 so that radiation from light source 34 strikes layer 28 in a regular screen pattern. Uniform charge 30 of FIG. 4A is discharged in the areas where light passes through screen 35 to strike photoconductive layer 28. Layer 28 is made conductive in the light-struck areas. The screen exposure leaves non-uniform charge pattern 36 on the surface of layer 28.

Lines 37 show the shape of the electric field created by non-uniform charge pattern 36. Lines 37 defining the field extend from the positive charges on top of layer 28 to the negative charges at the interface between layer 28 and substrate 29. The shape of the field is seen to be suitable for development by uncharged marking particles as discussed in detail in connection with FIG. 2. It is also seen that finer regular microfields defined by lines 37 are possible in thinner layers 28, giving rise to higher definition.

Figure 4C:
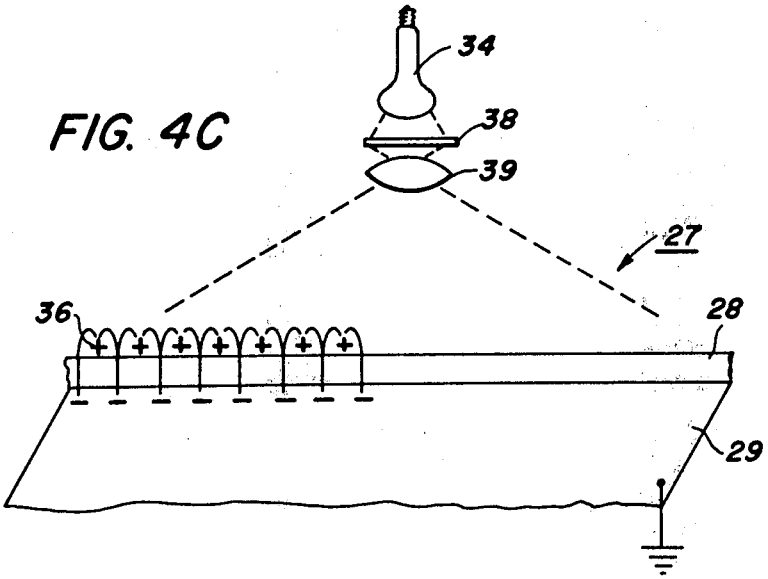

In FIG. 4C, non-uniform charge pattern 36 of FIG. 4B is exposed to an imagewise pattern of radiation to which layer 28 is sensitive. The radiation is from light source 34, and it passes through transparency 38 and optical system 39. Transparency 38 blocks some of the radiation from light source 34 and allows some light to pass through system 39 to strike layer 28 in an imagewise pattern.

In the light struck area of layer 28, non-uniform charge pattern 36 is dissipated, because layer 28 becomes conductive in the light struck area. In the non-light struck area, the non-uniform charge pattern remains on photoconductive layer 28. By such imagewise exposure, non-uniform charge pattern 36 is made to be an imagewise non-uniform charge pattern.

It will be apparent to those skilled in the art that the imagewise exposure of FIG. 4C could precede the exposure to the screen pattern of FIG. 4B with substantially the same results.

In a useful variation of this process the screen exposure of FIG. 4B and the imagewise exposure of FIG. 4c are combined. The resulting non-uniform charge pattern in the light struck areas is developable as explained in connection with FIG. 2. The uniform charge pattern in the non-light struck areas is not developable by the uncharged particles such as particles 12 of FIG. 2. Thus, a dark-for-light reverse image of the original is created.

Figure 4D:
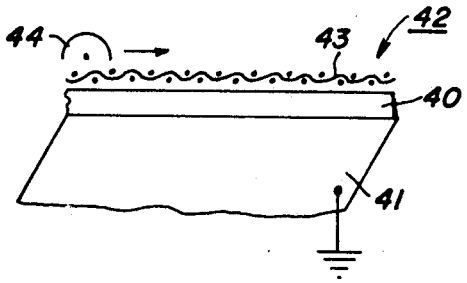
Figure 4E:
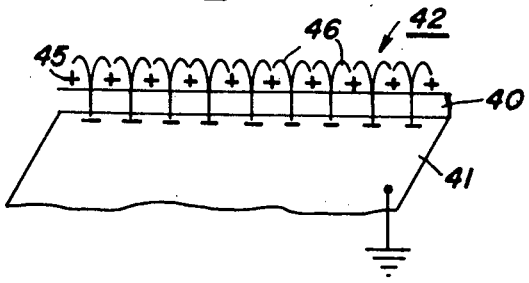

An alternative method of forming an imagewise charge pattern is depicted in cross-section in FIGS. 4D–E.

In FIG. 4D, a photoconductive layer 40 is placed on grounded conductive substrate 41 to form imaging member 42 similar to member 27 of FIG. 4A. Insulating screen 43 is positioned on layer 40, and corona charged device 44 is moved across screen 43 in the direction shown by the arrow. A positive charge is applied to corona charging device 44, and a layer of positive charge is placed on photoconductive layer 40 in a pattern matching the openings in screen 43.

FIG. 4E shows the non-uniform charge pattern 45 established on layer 40 by charging through screen 43. Because photoconductive layer 40 is supported on grounded conductive substrate 41, negative charges are drawn to the interface between substrate 41 and layer 40. Lines 46 depict the electric field created on layer 40.

Non-uniform charge pattern 45 on member 42 is made to be an imagewise non-uniform charge pattern by an imagewise exposure step such as that shown in FIG. 4C.

Figure 4F:
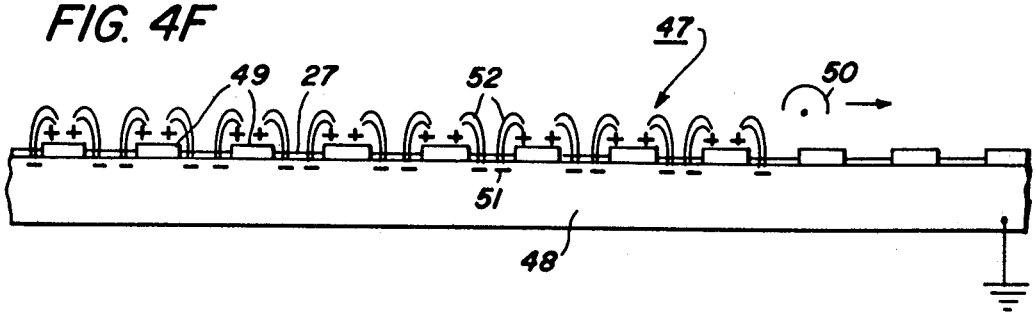

Still another useful procedure for placing a non-uniform charge pattern on a surface is shown in FIG. 4F. Imaging member 47 includes grounded conductive substrate 48 on which a substantially regular pattern of photoconductive deposits 49 have been placed. A leaky insulator layer 27 (resistivity from about $10^{12}$ to about $10^{13}$ ohm cm) surrounds deposits 49.

Corona device 50 moves over member 47 in the dark in the direction shown by the arrow while a positive charge is applied to it. A positive charge is left on deposits 49, after the field across the leaky insulator collapses. The shape of the fields between the charges on deposits 49 and the corresponding charges of opposite polarity in substrate 48 are shown by lines 52. A non-uniform charge pattern is established on member 47.

The non-uniform charge pattern on member 47 can be made into a useful imagewise non-uniform charge pattern by the procedure shown in FIG. 4C for member 27.

Figure 5A:
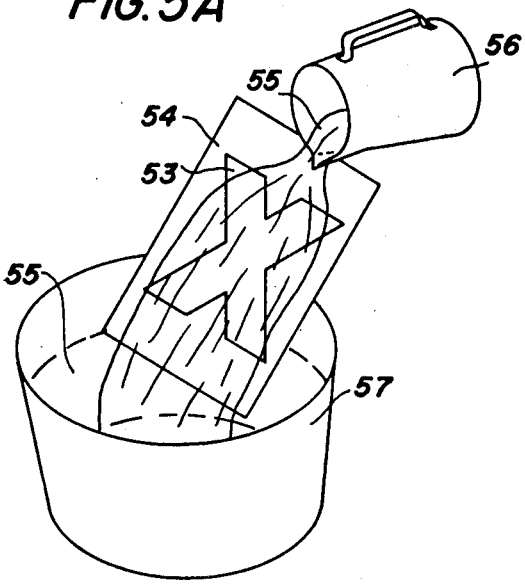
FIGS. 5A–C show methods for contacting a surface containing a non-uniform charge pattern with marking particles.
Figure 5B:
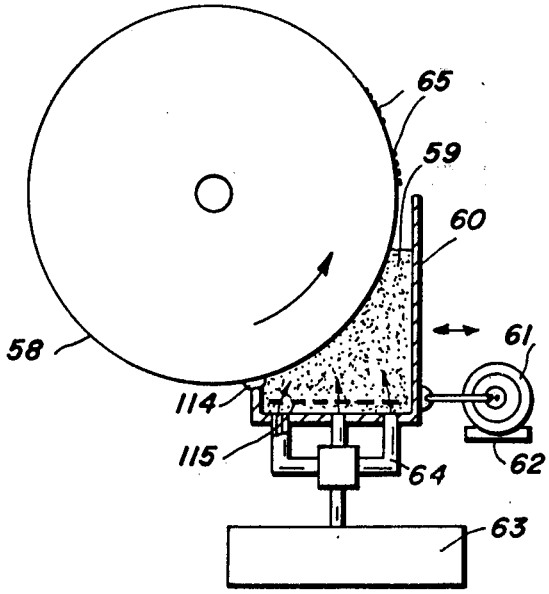
Figure 5C:
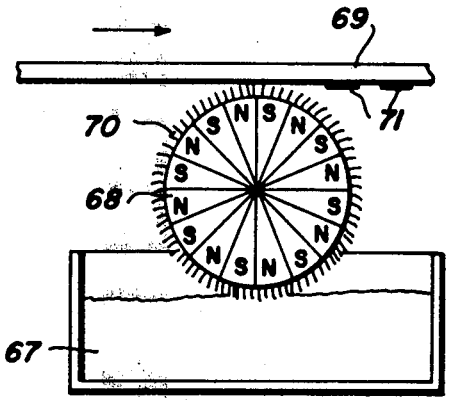

FIGS. 5A–C show various useful methods for developing imagewise non-uniform charge patterns.

In FIG. 5A, there is shown schematically and in perspective view an arrangement for developing an imagewise non-uniform charge pattern by flowing colored, uncharged particles of marking material across the pattern. Non-uniform charge pattern 53 is in the imagewise form of an *x* on the surface of member 54. It is to be understood that in FIGS. 5A-C the imaging surface, such as the surface of member 54, can be either an insulating layer or a photoconductor as discussed in detail in connection with FIG. 2. It is also to be understood that imagewise patterns, such as pattern 53, can be formed by any suitable method, such as the methods discussed in connection with FIGS. 3 and 4.

Particles 55 are poured onto the surface of member 54 from container 56 and allowed to flow across member 54 and the image it contains. When particles 55 encounter a non-uniform field, they are drawn to it by the resultant downward vector of the forces in the field as described in connection with FIG. 2.

In the flowing method of development, particles 55 which do not adhere surface 54 to mark image 53 are collected in sump 57 and may be reused.

FIG. 5B shows in cross-section a method for contacting an imaging surface using a fluidized bed of marking particles.

Imaging surface 58 is a drum which carries an imagewise non-uniform charge pattern on its surface. The drum rotates so that surface 58 passes through a fluidized bed of marking particles. Any suitable method for creating a fluidized bed of marking particles may be used. In FIG. 5B, the method for creating a fluidized bed is a combination of vibration and air flow.

Particles 59 are held in container 60. Container 60 is vibrated by vibrating motor 61 which is fixedly attached to stationary member 62. While particles 59 are vibrated, air is passed through them from compressed air supply 63. The air enters the bottom of container 60 through nozzles 64 and is spread by impedence plate 115.

The combination of vibration and air flow create a fluidized bed of particles 59. Surface 58 passes readily through the bed and particles 59 uniformly contact surface 58. Insulating plug 114 prevents particles 59 from spilling from container 60 without disturbing the non-uniform imagewise charge pattern on the surface of drum 58. Particles 59 are attracted to surface 58 by the imagewise non-uniform charge pattern thereon. In FIG. 5B, imagewise pattern 65 can be readily identified where it has been marked by particles 59.

FIG. 5C shows in cross-section a magnetic brush development system which is also useful for bringing marking particles into contact with a surface bearing a non-uniform charge pattern.

A supply of marking particles 66 impregnated with a magnetic material is held in container 67. Roller 68 is positioned to contact the surface of the supply of particles 66. Roller 68 is divided into isolated segments substantially as shown in the drawing.

Alternate segments are of magnetically opposite polarities.

Marking particles 66 are picked up from container 67 by roller 68 as it rotates in the direction shown by the arrow. A "brush" of particles 66 held on the surface of roller 68 is brushed against surface 69 as roller 68 rotates. Surface 69 contains an imagewise non-uniform charge pattern which attracts particles 66 from brush 70. The strength of the magnetic fields holding brush 70 to roller 68 is weaker than the imagewise non-uniform field on surface 69. Particles 66 attracted to surface 69 mark imagewise non-uniform charge pattern 71.

The segmented roller 68 could alternatively be charged to positive and negative potentials instead of having segments of opposite magnetic polarity. In the case of oppositely charged segments, the uncharged particles are held on roller 68 to form brush 70 by the non-uniform fields above the surface of roller 68. In such as alternative embodiment, the toner particles are not necessarily magnetic and can be of a greater variety of colors.

A surface bearing a non-uniform charge pattern can also be developed with a liquid developer having marking particles suspended in a liquid carrier. However, suitable combinations of carrier and toner particles are difficult to select because the present development system relies on neutral particles (0 zeta potential). Most particles suspended in a liquid have a finite zeta potential and will react with coulombic forces in the presence of a field. For this reason, the liquid development system is not preferred.

In some instances, it will be desirable to fix the particles directly onto the surface which they mark. In other instances, it will be desirable to transfer the marked image to a receiver sheet.

Figure 6A:
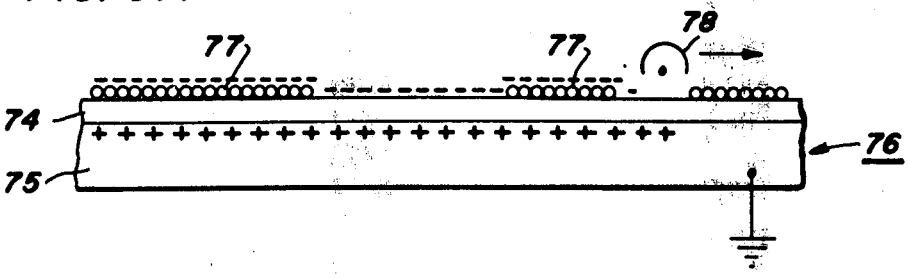
FIGS. 6A–B show a method for transferring a developed image to a receiving surface.
Figure 6B:
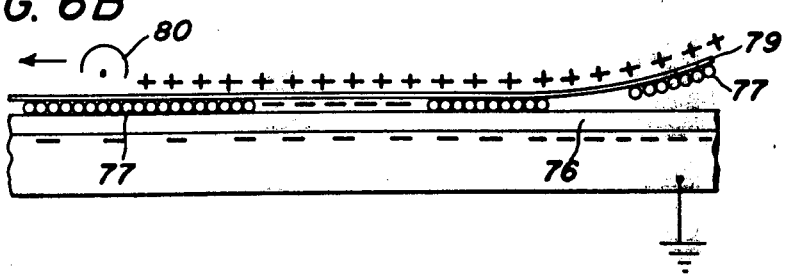

Transfer of marking particles from a surface on which marking occurs to a receiving surface is illustrated in FIGS. 6A–B.

FIG. 6A shows in cross-section a grounded imaging member 76 on which marking particles 77 have been deposited in an imagewise pattern. Member 76 includes photoconductive layer 74 and grounded conductive substrate 75. Particles 77 are held to member 76 by a non-uniform charge pattern and have no charge of their own. In the transfer method illustrated here, the marking particles are first given a negative charge by corona device 78 as it moves past the particles as shown by the arrow.

The next step of this transfer method is shown in FIG. 6B which is also a cross-sectional view. Negatively charged particles 77 are sandwiched between member 76 and receiver sheet 79. Although any suitable receiver sheet may be used, receiver sheets are typically paper.

Corona device 80 moves across the back of receiver sheet 79 and places a uniform positive charge on it. The positive charge creates a transfer field of sufficient strength to tack the negatively charged toner particles 77 to receiver sheet 79 so that particles 77 remain attached to sheet 79 when sheet 79 is separated from surface 76 as shown in FIG. 6B.

Whether transferred to a receiver sheet or left on the original surface, it is often desirable to fix the marking particles. Two suitable fixing procedures are shown in FIGS. 7A and B.

Figure 7A:
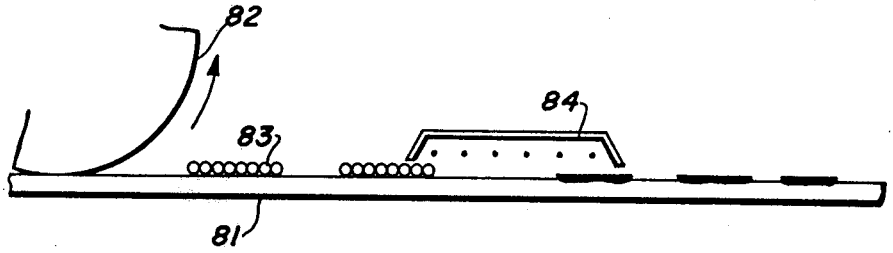
FIGS. 7A and B show methods for fixing the developed image to a surface.

FIG. 7A shows in cross-section a heat fusing fixing means. Receiver sheet 81 is separated from imaging surface 82, as shown. Imaging surface 82, in this embodiment, is typically a drum having either an insulating surface or a photoconductive surface. Receiver sheet 81 in such an embodiment is typically a paper web.

Marking particles 83 are transferred to receiving surface 81 by any suitable process, such as the one typified by that shown in FIGS. 6A and B. Particles 83 are transferred to receiving surface 81 in an imagewise pattern corresponding to the imagewise non-uniform charge pattern developed on surface 82 (see FIG. 2).

Marking particles 83 typically are made from colored thermoplastic material. The material is selected to melt at high temperatures.

As the receiving surface moves in the direction shown by the arrow, it passes under fusing means 84. Fusing means 84 is an electric coil which radiates heat when a current is passed through it. A reflector directs heat from the coil onto the thermoplastic marking particles 83 causing them to fuse together and to combine with the material of receiving sheet 81. The heat reduces the viscosity of the toner material so that it can flow into the receiver sheet as an ink. Such fusing and combining is generally referred to as fixing.

Heat fusing systems are well known in the xerographic arts, and a variety of useful such systems will readily come to mind. For example, heat fusing with xenon flash lamps or ovens are useful alternative to the system shown in FIG. 7A.

Figure 7B:
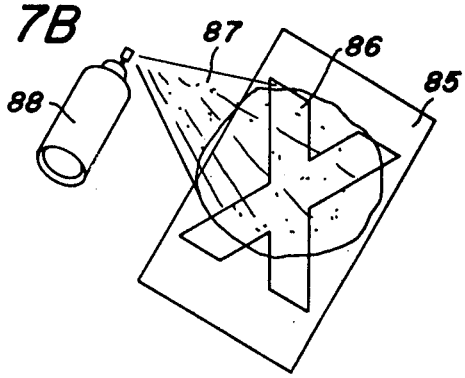

Another useful fusing system is shown in perspective view in FIG. 7B. Surface 85 is similar to surface 54 of FIG. 5A, and developed (marked) non-uniform charge pattern 86 is similar to pattern 53 of FIG. 5A. Developed charge pattern 86 is to be fixed directly onto surface 85 without being first transferred to a receiving surface.

Lacquer 87 is sprayed onto pattern 86 to attach it to surface 85. Lacquer is sprayed onto pattern 86 by aerosol can 88. Other similar suitable fixing means which are useful in the present invention will be readily apparent to those skilled in the art. For example, solvent vapor fixing could be used. Trichloroethylene and 1,1,1-trichloroethane are two well known vapor solvents for soluble thermoplastic resins. The spray fixing method shown in FIG. 7B is preferred for both lacquer and solvents because it minimizes the possibility of disturbing the marking particles during fixing.

Figure 8:
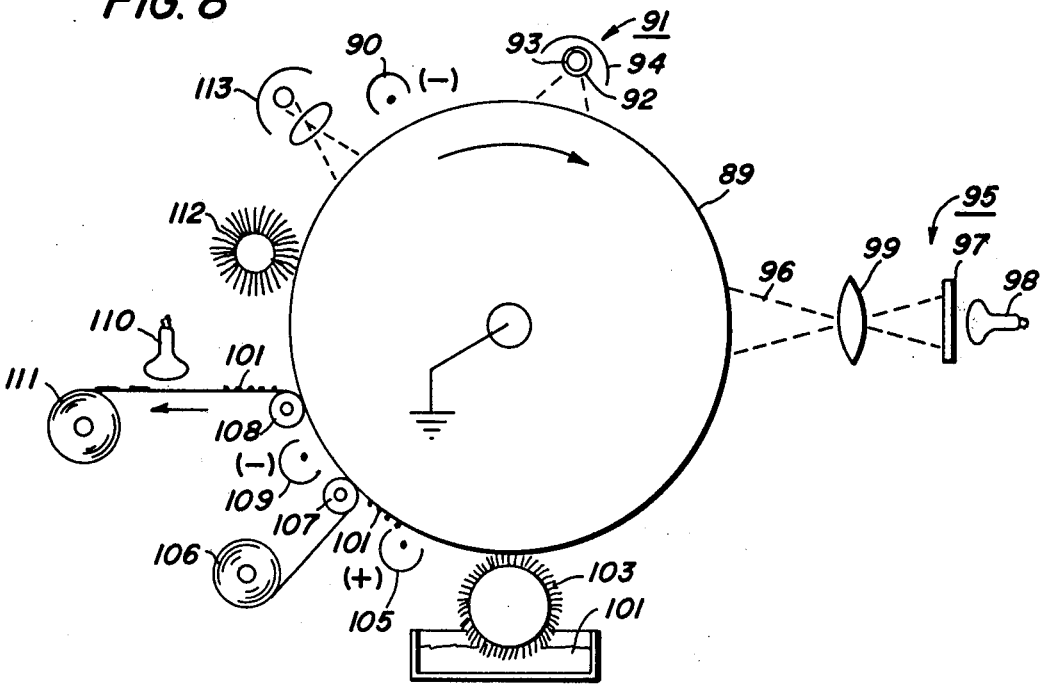
FIG. 8 shows an imaging appatatus for performing the method of the present invention.

FIG. 8 shows in cross-section an imaging apparatus which performs the method of the present invention to produce images on a receiving sheet. The apparatus of FIG. 8 is illustrative of a variety of similar devices which are useful to mark imagewise non-uniform charge patterns on receiving sheets or on original surfaces.

Drum 89 rotates in the direction indicated by the arrow. Its outer surface is a 6 micron layer of arsenic doped selenium, a photoconductive material. The photoconductive layer is coated onto a conductive substrate. The substrate is grounded as shown.

As drum 89 rotates, it receives a uniform negative charge on its photoconductive outer surface from corona device 90. The charging is done in the dark, and a uniform charge pattern is set up on the surface of drum 89 (see FIG. 4A).

At screen exposure station 91, a transparent tube 92 with a screen pattern marked on its surface rotates as shown by the arrow. Fluorescent tube 93 and reflector 94 direct light through the screen pattern on tube 92 to project a light and dark screen pattern on the charged surface of drum 89. The rotational speed of tube 92 is synchronous with the peripheral speed of drum 89 so that the peripheral speed of drum 89 and the speed of the projected screen pattern on drum 89 are substantially the same. If the screen pattern is a line pattern parallel with the direction of rotation of drum 89, a non-moving optical system could be used.

The charge is dissipated in the light struck areas, leaving a non-uniform charge pattern on the surface of drum 89 (see FIG. 4B).

It is to be understood that the regular non-uniform charge pattern on the face of drum 89 could also be accomplished with a stylus as discussed above.

When the drum moves to imaging station 95, it is exposed to imagewise pattern of light 96. Slide 97 modifies light from the light source so that imagewise pattern of light 96 passes through optical system 99 and strikes the non-uniform charge pattern on the surface of drum 89. The non-uniform charge pattern is dissipated in the light-struck areas, leaving an imagewise non-uniform charge pattern (see FIG. 4C).

It will be understood by those familiar with the xerographic arts that resolution of the imagewise non-uniform charge pattern on the surface of drum 89 is improved whenever transparency 97 is moved synchronously with drum 89 during exposure. Such movement avoids "smearing" of the projected image. Another well known technique for minimizing image "smearing" is to use flash illumination of light source 98 while transparency 97 is held stationary.

It is to be understood that the imagewise non-uniform charge pattern could be placed on surface 89 entirely by styli and that, in the case of styli charging, surface 89 could be an insulating layer.

The imagewise non-uniform charge pattern on the surface of drum 89 is marked by contacting the surface with marking particles at development station 100. A supply of marking particles 101 is held in reservoir 102. The particles are brought into contact with the surface of drum 89 by brush 103. Brush 103 is similar in construction and operation to the brush described in detail in FIG. 5C. Marking particles 101 mark the imagewise non-uniform charge pattern on the surface of drum 89 as described in greater detail in connection with FIG. 2.

Particles 101 which mark the non-uniform charge pattern are transferred from the surface of drum 89 to receiving sheet 104 substantially by the process shown in FIGS. 6A and B. The particles are first charged to a positive potential by corona device 105. Receiving sheet 104, which in most cases is a paper web, is unwound from supply roll 106 and around guide rollers 107 and 108. Positively charged particles 101 are sandwiched between sheet 104 and drum 89 as the sheet and drum move in contact between guide rollers 107 and 108.

A negative charge is applied to the back of sheet 104 by corona device 109. The negative charge attracts positively charged marking particles 101 so that the particles adhere to sheet 104 when the sandwich is separated at roller 108.

In the exemplary embodiment of FIG. 8, transferred particles 101 are fused to sheet 104 by heat from xenon flash lamp 110. Heat fusing is explained in greater detail in connection with FIG. 7A.

After fusing, sheet 104 is rewound on take-up roll 111. It is clear that sheet 104 could be cut into convenient page sizes instead of being rewound. It will be equally clear to those familiar with the arts of xerography and paper handling that sheet 104 could be supplied in cut pages rather than as a web without altering the basic transferring and fixing steps.

The surface of drum 89 is prepared for subsequent cycles by cleaning with brush 112. Brush 112 rotates against the drum surface to remove residual marking particles 101 and lint from web 104. The surface is then uniformly exposed to light from fluorescent tube 113 to discharge any remaining charge from the photoconductive surface.

The invention is described below by way of example.

EXAMPLE I

Photoconductive layers of selenium are evaporated onto six aluminum plates (Samples A–G) by well known vacuum coating techniques. The plates have dimensions of about 9 inches by 12 inches. The thickness of the photoconductive layer is varied as shown in Chart I-1 below.

Each plate is uniformly charged in the dark to a surface potential giving an internal field of about 15 v. per micron, and then exposed to a light through a 50 percent hard dot tint screen available from Bychrome so that a screen pattern of light and dark falls on the charged photoconductive layer. Exposure is by a 40 watt tungsten lamp.

Subsequently, the selenium layer is exposed to an image projected onto it by a slide projector. The image is a dark "X" on a white field.

Blue marking particles of about 10 microns diameter made from a copolymer of polystyrene and polymethylmethacrylate, a thermoplastic resin, pigmented with phthalocyanine blue, are flowed across the surface in the dark by pouring. The particles have a dielectric constant of about 3.0. The beads are uncharged.

Chart I-1

| Sample | Se Thickness (microns) | Results of Procedure |
|---|---|---|
| A | 1 | No Image Developed |
| B | 2 | Poor Image Developed |
| C | 2.5 | Useful Image Developed |
| D | 5 | Good Image Developed |
| E | 10 | Good Image Developed |
| F | 25 | Good Image Developed |
| G | 60 | Good Image Developed |

Sample E of Chart I-1 is charged to various voltages as shown in Chart I-2, below. After charging, it is exposed to a screen pattern and contacted with marking particles as in Chart I-1 except that yellow marking particles are used. The yellow particles are formed from a copolymer of polystyrene and polymethylmethacrylate, and are colored with benzidene yellow pigment. The particles have a dielectric constant of about 3.0.

After each development attempt, Sample D is cleaned by brushing with a nylon bristle brush and exposure to a 30 watt fluorescent tube.

Chart I-2

| Sample | Charge | Results |
|---|---|---|
| E | 25 v. | No Development |
| E | 50 v. | Poor Development |
| E | 80 v. | Good Development |
| E | 100 v. | Good Development |
| E | 200 v. | Good Development |

It is seen from Chart I-1 that an inorganic photoconductor coated on a conductive substrate is useful in the present invention at coating thicknesses of at least about 2 microns in the presence of a field having a strength of about 15 v./micron. It is seen from Chart I-2 that brushing the light-discharging are useful in recycling a plate for use in the method of this invention.

It is seen from Charts I-1 and I-2 that uncharged thermoplastic resins of various colors are useful in marking the charge pattern on the surface. It is also seen from Charts I-1 and I-2 that flowing the marking particles across the surface is a useful contacting technique. One useful method for producing an imagewise non-uniform charge pattern is apparent from Example I.

EXAMPLE II

Samples H–N are prepared in the same coating thicknesses as were Samples A–G, respectively, except that PVK/TNF, a well known organic photoconductive material, is used. Samples H–N are examined by the same procedure outlined for Samples A–G, except that the photoconductive surfaces are contacted with magenta uncharged marking particles made from the same resin colored with bonadur red pigment.

Substantially the same results are observed, indicating that organic photoconductive materials are useful in the present invention to about the same degree as inorganic photoconductive materials. Further indication is provided that the process of the present invention allows marking in a variety of colors.

EXAMPLE III

Samples E and L from Examples I and II are charged to +800 v. and then exposed to a 40 watt incandescent lamp through a transparent screen which carries a 500 line/inch Ronci ruling.

After charging, the screen is separated from the photoconductive surface and the surface is exposed to a projected image as in Examples I and II except that the image is a silhouette of a gavel. The gavel silhouette is projected by a 500 watt bulb through a transparency in a Kodak Carousel projector from a distance of 5 feet.

Samples E and L are then contacted with uncharged black marking particles by the brush method. A brush arrangement is constructed substantially as shown in FIG. 5C. The segments of the brush roller are, of magnetically opposite polls. The reservoir is filled with 19.5 micron averaged diameter marking particles available from 3M under the tradename A-09 Toner. The particles are thermoplastic resin impregnated with $Fe_3O_4$. In each development step by the brush method and by subsequent development methods (see Chart III-1), the gavel handle is contacted by the developer prior to the gavel head. The results are noted in Chart III-1.

Samples E and L are then cleaned by brushing and exposure to light and subjected to the same procedure again, except that instead of brush development, fluidized bed development and flowing development are used. A fluidized bed is constructed substantially as shown in FIG. 5B. The reservoir is caused to vibrate at a frequency of about 100 Hz. while air of about 2 atmospheres pressure is passed through a bed of A-09 Toner particles.

Flowing development is achieved as in Examples I and II (FIG. 5A), except A-09 developer particles are used.

Finally, Samples E and L are subjected to a xerographic process wherein they are uniformly charged to +800 v. and then exposed directly to the gavel silhouette. After exposure, the samples are developed by xerographic systems, cleaned and reused, as with systems of the present invention. After the first exposure Xerox 914 developer is cascaded over the samples. Subsequently, the samples are developed by the same toner held in a fluidized bed and held by a magnetic brush. The results of these development procedures are also noted in Chart III-1.

Chart III-1

| Samples | Type of Imaging | Type of Development | Results |
|---|---|---|---|
| E & L | Present Invention | Brush | Good Solid Area Coverage |
| E & L | Present Invention | Flowing | Good Solid Area Coverage |
| E & L | Present Invention | Fluidized Bed | Good Solid Area Coverage |
| E & L | Xerography | Brush | Solid Area Coverage Except Developer Starvation Noted* |
| E & L | Xerography | Cascade | Edge Development |
| E & L | Xerography | Fluidized Bed | Edge Development |

*Developer starvation is a well known descriptive phrase in xerography indicating that good solid area coverage in one area detracts from solid area coverage in another area. In Example III, the gavel handle, which encountered the magnetic brush first, is solidly developed; but a corresponding light streak is observed in the body of the gavel'is silhouette.

It is seen from Example III that the present invention provides solid area marking of images without developer starvation in situations where xerographic processes cannot. Further, it is seen that flowing, fluidized bed and brush development are all useful in the present invention. An alternative method of forming a non-uniform charge pattern on a photoconductive surface is seen.

EXAMPLE IV

Samples O–R are four specimens of Xerox Mobile Printer paper, which is a conductive paper having a thin insulating overcoating. Each sample is charged by a moving stylus while the paper is held against a grounded conductive support. The stylus is a bar which moves across the insulating coating at the rate of 1 inch/sec. The bar is alternatively charged to ±100 v. at a frequency of 1,000 Hz. and is alternatively turned on and off each one-half inch.

After charging, the marking material of Example II is cascaded across the surface. The results are observed and recorded in Chart IV-1, below.

Chart IV-1

| Sample | Coating Thickness | Results |
|---|---|---|
| O | 0.5 micron | No Development |
| P | 1.0 micron | Useful Development |
| Q | 5.0 microns | Good Development |
| R | 15.0 microns | Good Development |

The image developed on Samples P–R is a repeating stripe pattern.

It is seen from Example IV that insulating layers are useful imaging surfaces for use in the present invention and that they can be coated onto such convenient support surfaces as ordinary paper. It is also seen that insulating layers as thin as 1 micron are useful in the method of the present invention with potentials of as little as 100 v. It is also seen from Example IV that styli can be successfully used to put down an imagewise non-uniform charge pattern useful in the present invention.

EXAMPLE V

An imagewise non-uniform charge pattern of the gavel silhouette of Example III is formed on Sample E by the process of Example III. Development of the pattern is attempted using a variety of 10 micron average particles having various dielectric constants. The results of the development efforts are noted in Chart V-1, below.

Charrt V-1

| Particle Material | Dielectric Constant | Results |
|---|---|---|
| Microspheres | 1.5 | Poor Development |
| Poly(styrene) | 2.45 | Good Development |
| Poly(methyl methacrylate)/ Poly(vinyl chloride) | 4.0 | Good Development |
| Melamine-formaldehyde resin | 7.9 | Good Development |

It is seen that particles having a dielectric constant of at least about 2.0 provide useful results.

EXAMPLE VI

Sample E is charged and exposed to an optical image as in Example IV. After exposure, it is contacted with the marking particles of Example I, except that the particles are of a different size. After each development attempt, Sample E is cleaned, re-imaged, and development with another size particle is tried. The various particle sizes used and the results observed are shown in Chart VI-1.

Chart VI-1

| Particle Size | Results |
|---|---|
| 2 microns | Image developed, but toner dust covered equipment and caused some undesirable background on the imaging surface. |
| 4 microns | Image developed, but toner dust covered equipment and caused some undesirable background on the imaging surface. |
| 5 microns | Good Development |
| 10 microns | Good Development |
| 20 microns | Good Development |
| 30 microns | Good Development. Image roughness is visible upon magnification. |
| 40 microns | Good development, but roughness is visible without magnification and is distracting from the image. |

It is seen from Chart VI-1 that from about 5 to about 30 microns in diameter is a preferred size range for use in the present invention.

EXAMPLE VII

In an effort to determine a preferred threshold ratio of marking particle size to frequency of the non-uniform charge pattern, 10 micron particles of the marking material of Example III are used to mark the stripe patterns of Example IV (Sample E) when they are placed on an insulating layer at various frequencies. In Chart VII-1, the frequencies and the development results are recorded. Frequency is defined as the reciprocal of the period. the period is the distance between $x$ and $y$ in FIG. 2.

Chart VII-1

| Period of Stylus | Results |
|---|---|
| 25 microns | Good |
| 50 microns | Good |
| 100 microns | Good |
| 150 microns | Good |
| 175 microns | Roughness begins to show in developed image. |
| 200 microns | Roughness in image is distracting. |

It is seen from Chart VII-1 that the preferred threshold ratio for marking particle size/frequency is about 10 microns/175 microns or 0.06. Ratios below 0.06 are not preferred, although they might be useful for some purposes.

EXAMPLE VIII

A magnetic imaging surface formed from $CrO_2$ uniformly embedded in a plastic sheet is provided. The sheet is uniformly magnetized in a non-uniform magnetic pattern by moving it past a stationary recording head. The sheet is then exposed to the gavel silhouette as were Samples E and L in Example III. Cascade development of the sheet is then attempted with 3M A-09 Toner.

The sheet is cleaned, remagnetized and development is attempted with the marking particles of Examples I and II.

When development is attempted with 3M A-09 black toner, which is magnetically attractable, excellent solid area coverage over the entire sheet is observed. No imagewise pattern is seen.

When development is attempted with the marking particles of Examples I and II, no development occurs.

It is seen from the observed results of Example VIII that although non-uniform magnetic patterns result in good solid area coverage with magnetically attractable toner, magnetic surfaces are not compatible with optical imaging. It is further seen that magnetic patterns are not markable by the colorful marking particles of Examples I and II.

The above description, examples and drawings will be sufficient to enable one skilled in the art to make and use the present invention and to distinguish it from other inventions and from what is old. It will be appreciated that other variations and modifications will occur to those skilled in the art upon reading the present disclosure. These are intended to be within the scope of this invention.

What is claimed is:

1. An apparatus for producing a visible image on a photoconductive imaging surface which comprises:

(a) a means for forming an imagewise non-uniform charge pattern having an average strength of at least about 100 volts on a photoconductive surface having a thickness of at least about 1.25 microns; and (b) a means for contacting the surface with finely divided uncharged marking particles having a dielectric constant of at least about 1.5 more than the surrounding medium.

2. The apparatus of claim 1 wherein the means for forming includes a charging means for uniformly charging the surface, an exposure means for discharging the surface in a regular pattern of light and dark and an exposure means for subsequently discharging the surface in an imagewise pattern.

3. The apparatus of claim 1 wherein the means for forming includes a means for placing a regular pattern of non-uniform charge on the surface and a means for discharging the regular pattern in an imagewise pattern.

4. The apparatus of claim 1 wherein the means for forming includes a means for uniformly charging the surface of a layer comprising a conductive substrate supporting a regular pattern of photoconductive deposits and a means for subsequently imagewise exposing the charged layer.

5. The apparatus of claim 4 wherein at least the portions of the surface not covered by deposits is coated with a leaky insulator.

6. The apparatus of claim 1 wherein the means for contacting is a magnetic brush positioned to apply to the surface finely divided uncharged marking particles containing a magnetically attractable material.

7. The apparatus of claim 1 wherein the means for contacting is an electric brush positioned to apply to the surface finely divided uncharged marking particles.

8. The apparatus of claim 1 wherein the means for contacting is an arrangement for flowing finely divided uncharged marking particles over the surface.

9. The apparatus of claim 1 wherein the means for contacting is a fluidized bed of finely divided uncharged marking particles positioned for contacting the surface.

10. The apparatus of claim 1 further including means for transferring the image to a receiving member.

11. The apparatus of claim 10 further including means for fixing the transferred image to the receiving member.

12. The apparatus of claim 1 further including means for fixing the image to the surface.

13. The apparatus of claim 1 further including means for cleaning and discharging the surface prior to reuse.

14. The apparatus of claim 1 wherein the imagewise non-uniform charge pattern has a period of from about 25 microns to 175 microns.

15. The apparatus of claim 1 wherein the marking particles have a diameter of from about 5 to about 30 microns.

16. The apparatus of claim 1 wherein the means for forming includes a charging means for uniformly charging the surface and means for simultaneously exposing the surface to a regular pattern of dark and light and an imagewise pattern of dark and light.

* * * * *